US005356744A

United States Patent [19]

Yanus

[11] Patent Number: 5,356,744

[45] Date of Patent: Oct. 18, 1994

[54] CONDUCTIVE LAYERS USING CHARGE TRANSFER COMPLEXES

[75] Inventor: John F. Yanus, Webster, N.Y.

[73] Assignee: Xerox Corporation, Stamford, Conn.

[21] Appl. No.: 457,856

[22] Filed: Dec. 27, 1989

[51] Int. Cl.[5] ..... G03G 15/04

[52] U.S. Cl. ..... 430/62; 430/64

[58] Field of Search ..... 430/62, 529, 922

[56] References Cited

U.S. PATENT DOCUMENTS

| | | | |
|---|---|---|---|
| 3,121,006 | 2/1964 | Middleton et al. . | |
| 3,357,989 | 12/1967 | Byrne et al. . | |
| 3,658,518 | 4/1972 | Baltazzi | 430/62 X |
| 3,684,362 | 8/1972 | Weigi . | |
| 4,036,648 | 7/1977 | Engler et al. . | |
| 4,052,208 | 10/1977 | Martinelli . | |
| 4,262,074 | 4/1981 | Halm . | |
| 4,265,990 | 5/1981 | Stolka et al. . | |
| 4,377,628 | 3/1983 | Ishioka et al. . | |
| 4,415,639 | 11/1983 | Horgan . | |
| 4,478,922 | 10/1984 | Perlstein et al. | 430/58 |
| 4,480,020 | 10/1984 | Kondo et al. . | |
| 4,494,856 | 1/1985 | Aoki et al. . | |
| 4,529,538 | 7/1985 | Kim . | |
| 4,664,995 | 5/1987 | Horgan . | |
| 4,803,011 | 2/1989 | Barraud et al. | 252/500 |
| 4,925,774 | 5/1990 | Barraud et al. | 430/296 |
| 4,954,406 | 9/1990 | Endo et al. | 430/62 X |
| 5,009,811 | 4/1991 | Nakamura et al. | 524/236 X |

OTHER PUBLICATIONS

Jeszka et al, "Conductive Polymer: Reticulate Doping With Charge-Transfer Complex", *Nature,* vol. 289 (Jan. 29, 1981), pp. 390-391.

Wheland et al., "Synthesis of Electrically Conductive Organic Solids", *Journal of the American Chemical Society,* 98, 3916-3925 (1976).

Melby et al, "Substituted Quinodimethans. II. Anion-radical Derivatives and Complexes of 7,7,8,8-Tetracyanoquinodimethan" pp. 3374-3387 (Sep. 5, 1962).

Acker et al., "Substituted Quinodimethans. I. Preparation and Chemistry of 7,7,8,8-Tetracyanoquinodimethan" vol. 84, pp. 3370-3374 (Sep. 5, 1962).

*Primary Examiner*—Marion E. Mc Camish

*Attorney, Agent, or Firm*—Oliff & Berridge

[57] ABSTRACT

An electrically conductive composition containing a charge transfer complex of a TCNQ salt and a donor molecule is obtained by dissolving a charge transfer complex in a solvent having a relative evaporation rate of less than about 30, and evaporating the solvent so that the charge transfer complex forms a network of fibrils, dendrites or sphericulites. Polymers may also be included in the composition.

33 Claims, 2 Drawing Sheets

1μ

CONDUCTIVE LAYERS USING CHARGE TRANSFER COMPLEXES

BACKGROUND OF THE INVENTION

This invention relates in general to electrophotography and, in particular, to electrically conductive materials and a method of producing such materials for use in an electrophotographic imaging member.

There is a need in various fields for conductive materials which are humidity insensitive and which can be easily coated. Such materials are especially needed for electrophotographic applications. For example, partially transparent conductive ground planes are extensively used in electrophotographic imaging members. These ground planes typically consist of a metal or metal oxide layer on a non-conductive support. The metal/metal oxide layer must be very thin to allow the transmission of light. To achieve thin layers, the metal/-metal oxide layer is applied to the substrate by vacuum deposition, adding a substantial cost burden to the imaging member design.

Solvent coating of a ground plane in an electrophotographic imaging member may be performed. However, the materials which can be solvent coated rely on ionic conduction and are generally humidity sensitive.

Charge transfer complexes containing tetracyanoquinodimethane (TCNQ) salts are highly conductive. A large number of charge transfer salts have been synthesized. In 1981, Polish workers published a "note" (Jeszka et al, Nature, vol. 289, Conductive Polymer: Reticulate Doping with Charge-Transfer Complex, Jan. 29, 1981) on the fabrication of conductive polymer films doped with TCNQ salts. A charge transfer complex loading of 2% provided conductivity through a dendritic crystalline network, which was induced by optimized fabrication procedures. These fabrication procedures include a substrate temperature of over 100° C. as well as use of O-dichlorobenzene solutions heated to 170° C., making film coating a difficult task.

U.S. Pat. No. 4,529,538 to Kim reported the effect of various polymers on the conductivity of N-methylphenazine/TCNQ salt. Filamentary (fibril) structures were noted in some of the binders. Although the solutions were coated at room temperature, the preferred use of dimethyl formamide (DMF) as solvent required controlled vacuum drying to achieve the desired conductive structures. Optimum concentration of charge transfer complex in the binder was 35%.

In electrophotography, an electrophotographic plate containing a photoconductive insulating layer on a conductive layer is imaged by first uniformly electrostatically charging its surface. The plate is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotographic plate to a support such as paper. This imaging process may be repeated many times with reusable photoconductive insulating layers.

An electrophotographic imaging member may be provided in a number of forms. For example, the imaging member may be a homogeneous layer of a single material such as vitreous selenium or it may be a composite layer containing a photoconductor and another material. One type of composite imaging member comprises finely divided particles of a photoconductive inorganic compound dispersed in an electrically insulating organic resin binder. U.S. Pat. No. 4,265,990 discloses a layered photoreceptor having separate photogenerating and charge transport layers. The photogenerating layer is capable of photogenerating holes and injecting the photogenerated holes into the charge transport layer.

Other composite imaging members have been developed having numerous layers which are highly flexible and exhibit predictable electrical characteristics within narrow operating limits to provide excellent images over many thousands of cycles. One type of multilayered photoreceptor that has been employed as a belt in electrophotographic imaging systems comprises a substrate, a conductive layer, a blocking layer, an adhesive layer, a charge generating layer, a charge transport layer and a conductive ground strip layer adjacent to one edge of the imaging layers. In such a device, the conductive layer is typically a metal layer formed by vacuum deposition.

There continues to be a need for conductive materials for electrophotographic applications.

SUMMARY OF THE INVENTION

It is an object of the invention to provide an electrically conductive material and a method for making the material, which material may be used in an electrophotographic imaging member.

It is an object of the invention to provide an electrically conductive material which is humidity relatively insensitive and which can be easily coated.

It is a further object of the invention to provide an electrically conductive material which is highly filamentary.

It is a further object of the invention to provide an electrically conductive material which may be used as a conductive layer in an electrophotographic imaging member.

The present invention provides an electrically conductive material of a charge transfer complex of a TCNQ salt and a donor molecule, which material is preferably in the form of an interwoven network of fibrils. The invention provides a method for obtaining the material, as well as an electrophotographic imaging member utilizing the material and a method of making such an imaging member.

BRIEF DESCRIPTION OF THE DRAWINGS

A more complete understanding of the present invention can be obtained by reference to the accompanying drawings wherein.

DESCRIPTION OF PREFERRED EMBODIMENTS

Figure 1:
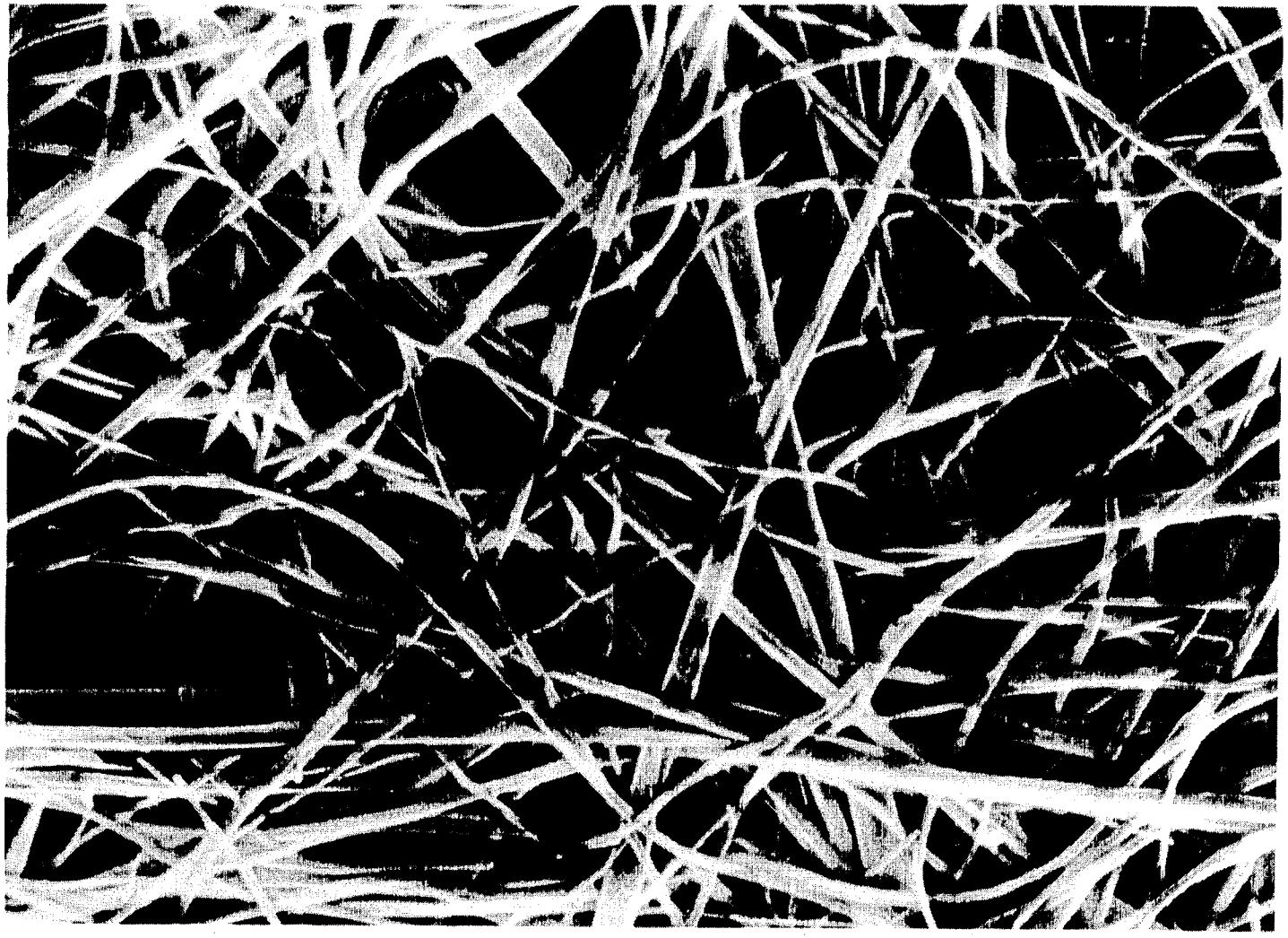
FIG. 1 is a scanning electron micrograph of fibrils in a composition of the invention.

The charge transfer complexes of the invention are complex salts of tetracyanoquinodimethane (TCNQ)

and a donor molecule. The donor molecules of the present invention are molecules which when complexed with TCNQ will form conductive materials. A resistivity less than 100,000 ohms/square can be obtained in the compositions of the invention.

TCNQ salts can be classified into two groups: simple salts containing a 1:1 mol ratio of cation to TCNQ and complex salts characterized by a TCNQ/cation mol ratio greater than 1 (typically 2 TCNQ to 1 cation). The present invention relates to charge transfer complex salts, preferably those having a TCNQ:donor ratio of 2:1. Most simple salts possess single crystal conductivities in the semiconductor range ($10^{-12}$–$10^{1}$ ohm-cm at 300° K.). Exceptions include N-methyl phenazonium and tetrathiafulvalene derivatives which exhibit single crystal conductivities of 500/ohm-cm at 300° K.

TCNQ charge transfer complexes may be synthesized by known procedures. Melby et al, "Complexes of 7,7,8,8-tetracyanoquinodimethane" JACS, Vol. 84, 3370–3387 (1962) discloses one such procedure. The charge transfer complexes of the present invention may also be prepared in-situ by dissolving the appropriate starting material in the coating solvent followed by a spray, dipping, rolling, drawbar, and the like, application on a substrate to form a film. The low temperature application methods available from the present invention permit wide latitude in substrate selection.

The compositions of the present invention may include a charge transfer complex and a polymer. Polymers such as film forming polymers may be added in order to disperse the charge transfer complexes therein.

The compositions of the present invention are obtained by dissolving a charge transfer complex with or without a film forming polymer in a solvent and evaporating the solvent. Heat may be necessary to effect a solution. The solvent chosen should have a particular relative evaporation rate in order to obtain the desired crystal structure. Relative evaporation rates, less than 30, preferably between about 5 and 30, and more preferably between about 10 and 25 may be used. These relative evaporation rates are based on the evaporation rate of ethyl ether being 1. Further, the solvent should dissolve the charge transfer complex at a useful concentration, but should not interact strongly with charge transfer complexes. It is often necessary to distill or otherwise purify commercial solvents to remove impurities which may disrupt the crystal structure of the charge transfer complexes in the final composition.

Three types of conductive crystal structures of the charge transfer complexes of the invention may be obtained. Filaments (fibrils) are preferred and are generally obtained by spraying charge transfer complex solutions or charge transfer complex/polymer solutions. Fibrils may be defined as small fibers having thread-like structures with a large length to width ratio. Dendritic crystal structures may be formed from charge transfer complex/polymer solutions which are coated, for example, by drawbar coating. Dendritic structures are branched tree-like structures containing a central rib with numerous side branches. Conductive coatings having a 1% loading of charge transfer complex in polymer films may be obtained having a dendritic structure. Sphericulites may be obtained in certain charge transfer complex/polymer mixtures which are drawbar coated. Sphericulites are circular structures which crystallize from a central point outward to a boundary of an adjacent crystal. These structures are most con, non with polymers such as Gantrez-169 (GAF) and polyvinylacetate.

The formation of the conductive crystal structures results from a balance between the rate of evaporation and the interaction of the solvent with the charge transfer complex. The evaporation method of the invention is to allow a film to dry at room temperature in the open air, which is generally for about two minutes. Retarding evaporation by, for example, enclosures, yields no dramatic improvements in the structures obtained. If spray coatings are made using a solvent such as cyclohexanone and the films are rapidly dried at 100° C., filamentary growth is greatly reduced and replaced by large blocky crystals. Large blocky crystals are undesirable as non-conductive layers are produced. Evaporation at less than 100° C., preferably at about 15°–50° C., and more preferably at ambient temperature, permits formation of filamentary crystal structures.

The length of the fibrils can be varied by altering the concentration of the charge transfer complex in the solution. Dilute spray solutions (for example, about 3 g/liter) yield shorter lengths of about 50 microns while more concentrated solutions (about 6 g/liter) yield lengths of several hundred microns.

By placing the wet film under a microscope, the fibrils can be observed growing. A fibril will grow as the solvent is evaporated to a point occupied by another fibril, and then continue growing under or over the obstacle. This observation may relate to the axial ordering found with TCNQ/donor crystals. A scanning electron micrograph (FIG. 1) illustrates the interwoven network of fibrils. These fibrils range from about 0.25 micron to about 2.0 microns in width and have lengths ranging from about 50 microns to about 500 microns.

Preferred donor molecules of the invention are 6-membered aromatic heterocycles containing nitrogen. Such donor molecules are capable of forming complex TCNQ salts with filamentary structures in compositions of the invention. Such donor molecules include pyridine type molecules such as pyridine, quinoline, acridine, alkyl pyrazinium, and phenanthrolines (hereinafter "pyridine type" molecules and derivatives thereof). Preferred donor molecules include pyridine, 3-picoline, 4-picoline, quinoline, quinaldine, lepidine, L-methylquinoline, isoquinoline, acridine, phenanthridine, 7,8-benzoquinoline, methyl pyrazinium, methyl quinoxalinium, methyl acridinium, 2,2-bipyridine, 4,4-bipyridine, 1,10-phenanthroline and methyl-1,10-phenanthrolinium.

Particularly preferred donors of the invention are as follows,

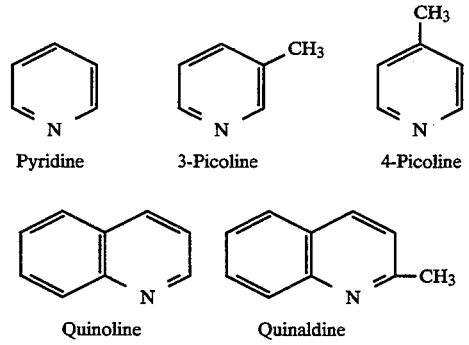

-continued

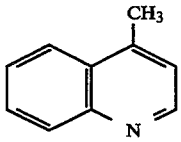

Lepidine

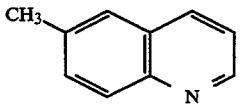

L-Methyl Quinoline

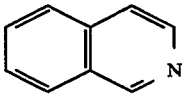

Isoquinoline

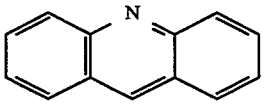

Acridine

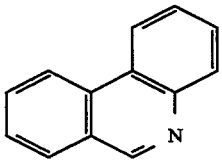

Phenanthridine

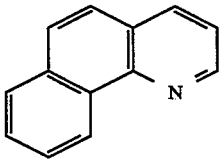

7,8-Benzoquinoline

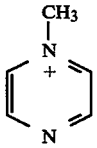

Methyl Pyrazinium

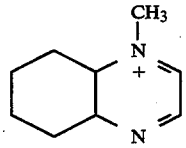

Methyl Quinoxalinium

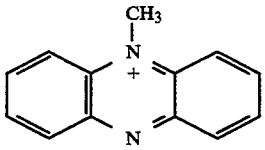

Methyl Acridinium

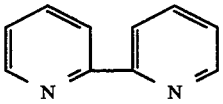

2,2-Bipyridine

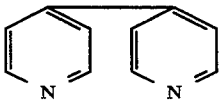

4,4-Bipyridine

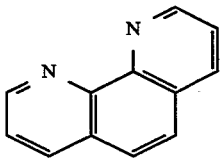

1,10 Phenanthroline

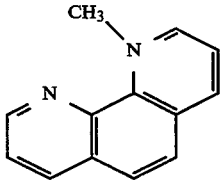

Methyl-1,10-Phenanthrolinium

Suitable solvents include cyclohexanone, cyclopentanone, propyleneglycolmonomethylether acetate, and mixtures thereof. Co-solvents may also be suitable. Cyclopentanone and cyclohexanone are preferred. Dilutions of these solvents with volatile, non-interacting solvents may be useful in allowing faster fabrication, provided that sufficient preferred solvent of the invention remains to form the conductive structures. The solvents may be used with solvents such as alcohols to facilitate fabrication.

The following table illustrates evaporation rates and boiling points of various solvents.

TABLE 1

| Solvent | Relative Evaporation Rate (Ethyl Ether = 1) | Boiling Point °C. |
|---|---|---|
| Cyclopentanone | 11.7 | 131 |
| Cyclohexanone | 22.2 | 157 |
| O-dichlorobenzene | 39.7 | 179 |
| Dimethylformamide (DMF) | 45.0 | 153 |

In the above table, O-dichlorobenzene and DMF have a relatively high evaporation rate, and therefore are undesirable in the present invention. These solvents require an extended period of time for drying which is impractical for production coatings. Multiple coating passes are possible with marginal solvents for the charge transfer complex such as cyclohexanone and cyclopentanone. Solvents such as DMF would completely dissolve any fibrils formed by the previous application.

Film forming polymers which may be used in polymer/charge transfer complex mixtures of the invention preferably include polycarbonate, polysulfone, polystyrene, polyvinyl acetate, phenoxy resin, Dupont 49,000 from du Pont, polymethylmethacrylate 4,4'-cyclohexylidene-diphenylpolycarbonate, hydroxypropyl cellulose and PE-200 from Goodyear Rubber and Tire Company. Other polymers which may be used, but are less preferred include Gantrez-169 from GAF and polyvinylcarbazole.

The charge transfer complex compositions or charge transfer complex/polymer compositions of the invention may be used as a layer or layers in an electrophotographic imaging member, for example, as a ground plane layer. From about 1 to about 40 weight percent, preferably about 2 to about 20 weight percent of the charge transfer complexes of TCNQ salt and a donor molecule, based on weight of the entire composition, may be dispersed in a film forming polymer. Photoreceptor devices are routinely heated to 100° C.–150° C. during processing. It appears that stability of the charge transfer complex layers is related to the volatility of the donor molecule. Pyridine forms the least stable charge transfer complex since after a few days at room temperature, the complex is no longer conductive. The picoline series is slightly more stable. The remaining pyridine-type donor molecules discussed above appear stable under high temperature and long term storage (up to 5 years).

Figure 2:
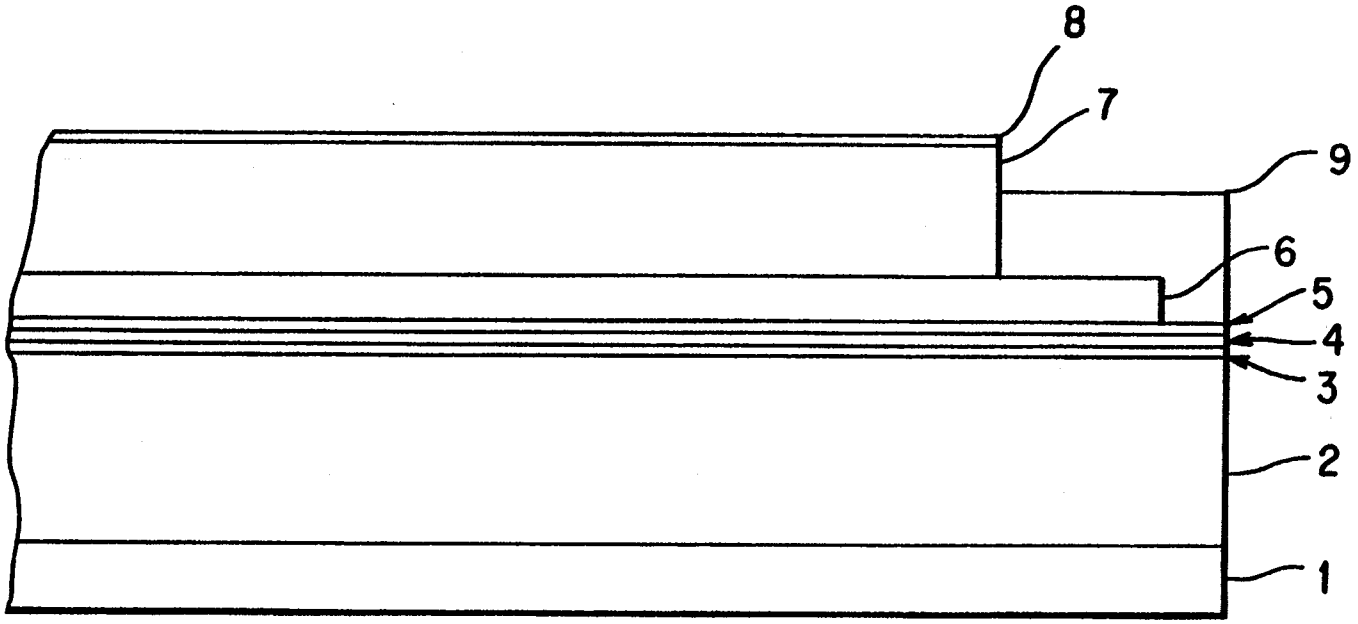
FIG. 2 is a cross-sectional view of an electrophotographic imaging member incorporating a ground plane layer of the invention.

An electrophotographic imaging men, bet may comprise a supporting substrate, an electrically conductive ground plane, a hole blocking layer, a charge generating layer and a charge transport layer. Optional layers such as adhesive layers for adhesion of adjacent layers, overcoating layers and anti-curl layers may also be incorporated. An example of an electrophotographic imaging member is shown in FIG. 2, provided with an anti-curl layer 1, a supporting substrate 2, an electrically conductive ground plane 3, a hole blocking layer 4, an adhesive layer 5, a charge generating layer 6, and a charge transport layer 7. An optional overcoating layer 8 is also shown in FIG. 2. In the above device, a ground strip 9 may be provided adjacent the charge transport layer at an outer edge of the imaging member. See U.S.

Pat. No. 4,664,995. The ground strip 9 is coated adjacent to the charge transport layer so as to provide grounding contact with a grounding device (not shown) during electrophotographic processes.

The supporting substrate 2 may be opaque or substantially transparent, and may comprise numerous suitable materials having the required mechanical properties. The substrate may further be provided with an electrically conductive surface. Accordingly, the substrate may comprise a layer of an electrically non-conductive or conductive material such as an inorganic or organic composition. As electrically non-conductive materials, there may be employed various resins known for this purpose including polyesters, polycarbonates, polyamides, polyurethanes, and the like. The electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E. I. du Pont de Nemours & Co., or Melinex, available from ICI Americas Inc.

The charge transfer compositions of the invention may be used in conductive substrates. However, because substrates generally have a thickness greater than about 100 microns, large quantities of expensive charge transfer complexes would be required. Solvent casting of conductive substrates with the material of the invention may also be problematic.

The thickness of the substrate layer depends on numerous factors, including economic considerations. The thickness of this layer may range from about 65 microns to about 150 microns, and preferably from about 75 microns to about 125 microns for optimum flexibility and minimum induced surface bending stress when cycled around small diameter rollers, e.g., 19 millimeter diameter rollers. The substrate for a flexible belt may be of substantial thickness, for example, over 200 microns, or of minimum thickness, for example less than 50 microns, provided there are no adverse effects on the final photoconductive device.

The electrically conductive ground plane layer 3 may comprise the charge transfer complexes of the present invention. The electrically conductive ground plane layer may be coated or sprayed onto the supporting substrate. The thickness of the ground plane layer using the charge transfer complex compositions of the invention may range from about 0.5 to about 10 microns, and preferably from about 1 to 2 microns.

The amount of charge transfer complex deposited onto the substrate is estimated to be the content of the solution per square foot of the substrate. Some losses due to overspray may be ignored, and the actual amount would be less than the estimated coverage. In any case, optimum devices (maximum conductivity) are found to be in the 25–30 mg charge transfer complex/square foot range (25–30 g/1000 sq. ft.).

Care must be taken to prevent mechanical abrasion of the surface to avoid damage. Since the charge transfer complexes are crystalline by nature, the interpenetrating fibril network must be overcoated with a polymer solution to encase the conductive layer.

A blocking layer 4 coated over the ground plane is necessary to prevent charge injection from the charge generation layer. A number of polymeric blocking layers may be used. However, special consideration must be given to the selection of the blocking layer, especially for charge transfer complex ground plane layers of the present invention coated without polymer. The charge transfer complex ground plane layer of the invention is porous and has a thickness of about 1 to 2 microns. Therefore, the blocking layer polymer solution must penetrate and coat the fibrils in the charge transfer complex ground plane layer without interacting with the fibrils. Since the surface area within the ground plane layer is enormous, interactions between solvents and poisoners are magnified.

Further consideration should be given to preventing migration of TCNQ into the charge generating and charge transport layers which will cause residual charge buildup in the electrophotographic imaging device. Basic polymers such as poly-4-vinylpyridine will prevent TCNQ migration, but attack TCNQ salts and destroy the conductivity thereof. Acidic polymers, such as polyacrylic acid and Gantrez 169, and neutral polymers will not interact with the charge transfer complex ground plane layer, but also fail to prevent TCNQ migration.

Thus, the blocking layer of the present invention preferably is formed by two layers. The first layer is provided to prevent interaction between the second blocking layer and the charge transfer complexes, while also providing an electrical barrier. The second blocking layer is provided to prevent charge transfer complex migration. The first blocking layer may comprise acidic or neutral polymers such as polyacrylic acid (PAA), Gantrez-169 which is a methylvinylether/maleic anhydride copolymer from GAF, Inc., polyvinylpyridine, with or without donor compounds such as quinoline, bipyridine, acridine, and the like, and mixtures thereof. The second blocking layer may comprise polymers such as polyvinyl pyridine, polyvinyl pyrrolidone, Gantrez-169 and polyacrylic acid.

In most cases, intermediate layers between the blocking layer and the adjacent charge generating (photogenerating) layer may be desired to promote adhesion. For example, an adhesive layer 5 may be employed. If such layers are utilized, they preferably have a dry thickness between about 0,001 micron to about 0.2 micron. Typical adhesive layers include film-forming polymers such as polyester, du Pont 49,000 resin (available from E. I. du Pont de Nemours & Co.), Vitel-PE-100 (available from Goodyear Rubber & Tire Co.), polyvinylbutyral, polyvinylpyrrolidone, polyurethane, polymethyl methacrylate, and the like.

Any suitable charge generating (photogenerating) layer may be applied to the adhesive layer. Examples of photogenerating layers include inorganic photoconductive particles such as amorphous selenium, trigonal selenium, and selenium alloys such as selenium-tellurium, selenium-tellurium-arsenic, selenium arsenide and phthalocyanine pigments such as the X-form of metal free phthalocyanine described in U.S. Pat. No. 3,357,989, metal phthalocyanines such as vanadyl phthalocyanine and copper phthalocyanine; squarylium; quinacridones available from du Pont under the tradename Monastral Red, Monastral Violet and Monastral Red Y; dibromo anthanthrone pigments available under the tradenames Vat orange 1 and Vat orange 3; benzimidazole perylene; substituted 2,4-diamino-triazines disclosed in U.S. Pat. No. 3,442,781; polynuclear aromatic quinones available from Allied Chemical Corporation under the tradenames Indofast Double Scarlet, Indofast Violet Lake B, Indofast Brilliant Scarlet and Indofast Orange; and the like, dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639. Other suitable photogenerating materials known in the art may also be utilized, if desired. Charge generating layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light.

Any suitable polymeric film forming binder material may be employed as the matrix in the photogenerating layer. Typical polymeric film forming materials include those described, for example, in U.S. Pat. No. 3,121,006. The binder polymer should adhere well to the adhesive layer, dissolve in a solvent which also dissolves the upper surface of the adhesive layer and be miscible with the adhesive layer to form a polymer blend zone. The solvent for the charge generating layer binder polymer should dissolve the polymer binder utilized in the charge generating layer and be capable of dispersing the photogenerating pigment particles present in the charge generating layer. Typical solvents include tetrahydrofuran, cyclohexanone, methylene chloride, 1,1,1-trichloroethane, 1,1,2-trichloroethane, trichloroethylene, toluene, and the like, and mixtures thereof. Mixtures of solvents may be utilized to control evaporation rates. For example, satisfactory results may be achieved with a tetrahydrofuran to toluene ratio of between about 90:10 and about 10:90 by weight. Generally, the combination of photogenerating pigment, binder polymer and solvent should form a uniform dispersion of the photogenerating pigment in the charge generating layer coating composition. Typical combinations include polyvinylcarbazole, trigonal selenium and tetrahydrofuran; phenoxy resin, trigonal selenium and toluene; and polycarbonate resin, vanadyl phthalocyanine and methylene chloride.

The photogenerating composition or pigment may be present in the resinous binder composition in various amounts. Generally, however, from about 5 percent by volume to about 90 percent by volume of the photogenerating pigment is dispersed in about 95 percent by volume to about 10 percent by volume of the resinous binder. Preferably from about 20 percent by volume to about 30 percent by volume of the photogenerating pigment is dispersed in about 80 percent by volume to about 70 percent by volume of the resinous binder composition. In one embodiment, about 8 percent by volume of the photogenerating pigment is dispersed in about 92 percent by volume of the resinous binder composition.

The photogenerating layer generally ranges in thickness from about 0.1 micron to about 5.0 microns, and preferably has a thickness of from about 0.3 micron to about 3 microns. The photogenerating layer thickness is related to binder content. Higher binder content compositions generally require thicker layers for photogeneration. Thicknesses outside the above ranges can be selected provided the objectives of the present invention are achieved. Any suitable and conventional technique may be utilized to mix and thereafter apply the photogenerating layer coating mixture to the previously dried adhesive layer. Typical application techniques include spraying, dip coating, roll coating, wire wound rod coating, and the like. Drying of the deposited coating may be effected by any suitable conventional technique such as oven drying, infrared radiation drying, air drying and the like, to remove substantially all of the solvents utilized in applying the coating.

The active charge transport layer may comprise any suitable transparent organic polymer or non-polymeric material capable of supporting the injection of photogenerated holes or electrons from the charge generating layer and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Angstroms to 9000 Angstroms. The active charge transport layer supports the injection of photogenerated holes or electrons from the photogenerating layer. The charge transport layer is preferably substantially transparent to radiation in a region in which the photoconductor is to be used when exposure is effected through the active layer. This ensures that most of the incident radiation is utilized by the underlying photogenerating layer for efficient photogeneration. When used with a transparent substrate, imagewise exposure or erase may be accomplished through the substrate with all light passing through the substrate. In this case, the active charge transport material need not be transmitting in the wavelength region of use. The charge transport layer in conjunction with the photogenerating layer is a material which is an insulator to the extent that an electrostatic charge placed on the transport layer is not conducted in the absence of illumination.

The active charge transport layer may comprise an activating compound (charge transport molecules) useful as an additive dispersed in electrically inactive polymeric materials making these materials electrically active. These compounds may be added to polymeric materials which are incapable of supporting the injection of photogenerated holes or electrons from the charge generating material and incapable of allowing the transport of these holes or electrons. This will convert the normally electrically inactive polymeric material to a material capable of supporting the injection of photogenerated holes or electrons from the charge generating material and capable of allowing the transport of these holes or electrons through the active layer in order to discharge the surface charge on the active layer. An especially preferred charge transport layer employed in one of the two electrically operative layers in multilayer photoconductors comprises from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture preferably comprises at least one aromatic amine compound of one or more compounds having the formula:

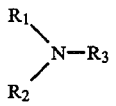

wherein $R_1$ and $R_2$ are each an aromatic group selected from the group consisting of a substituted or unsubstituted phenyl group, a naphthyl group, and a polyphenyl group, and $R_3$ is selected from the group consisting of a substituted or unsubstituted aryl group, an alkyl group having from 1 to 18 carbon atoms and a cycloaliphatic group having from 3 to 18 carbon atoms. The substituents should be free from electron withdrawing groups such as $NO_2$ groups, CN groups, and the like. Typical aromatic amine compounds that are represented by this structural formula include:

I. Triphenyl maines such as:

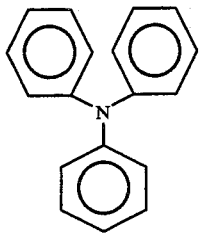

II. Bis and poly triarylamines such as:

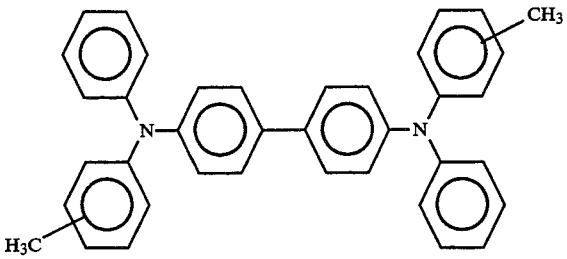

III. Bis arylamine ethers such as:

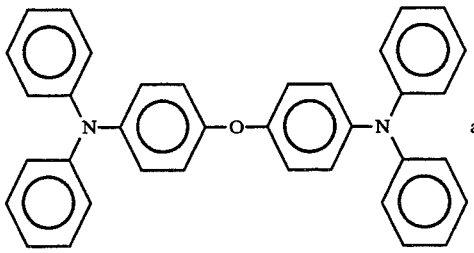

and

IV. Bis alkyl-arylamines such as:

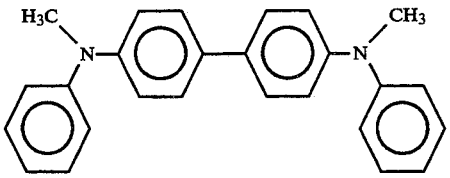

A preferred aromatic amine compound has the general formula:

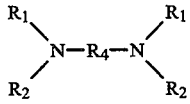

wherein $R_1$ and $R_2$ are as defined above, and $R_4$ is selected from the group consisting of a substituted or unsubstituted biphenyl group, a diphenyl ether group, an alkyl group having from 1 to 18 carbon atoms, and a cycloaliphatic group having from 3 to 12 carbon atoms. The substituents should be free from electron withdrawing groups such as $NO_2$ groups, CN groups, and the like.

Examples of charge transporting aromatic amines represented by the structural formulae above for charge transport layers capable of supporting the injection of photogenerated holes of a charge generating layer and transporting the holes through the charge transport layer include: triphenylmethane, bis(4-diethylamine-2-methylphenyl)phenylmethane; 4'-4''-bis(diethylamino)-2', 2''-dimethyltriphenylmethane; N,N'-bis(alkylphenyl)-(1,1'-biphenyl)-4,4'-diamine wherein the alkyl is, for example, methyl, ethyl, propyl, n-butyl, etc.; N,N'-diphenyl-N,N'-bis(3''-methylphenyl)-(1,1'-biphenyl)-4,4'-diamine; and the like;

Any suitable inactive resin binder soluble in methylene chloride or other suitable solvents may be employed. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other appropriate solvents may include tetrahydrofuran, toluene, trichloroethylene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin material are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; a polycarbonate resin having a molecular weight of from about 50,000 to about 100,000, available as Makrolon from Farbenfabricken Bayer A.G.; a polycarbonate resin having a molecular weight of from about 20,000 to about 50,000, available as Merlon from Mobay Chemical Company; polyether carbonates; and 4,4'-cyclohexylidene diphenyl polycarbonate. Methylene chloride solvent is a desirable component of the charge transport layer coating mixture for adequate dissolving of all the components and for its low boiling point.

An especially preferred multilayered photoconductor comprises a charge generating layer comprising a binder layer of photoconductive material and a contiguous hole transport layer of a polycarbonate resin material having a molecular weight of from about 20,000 to about 120,000 having dispersed therein from about 25 to about 75 percent by weight of one or more compounds having the formula:

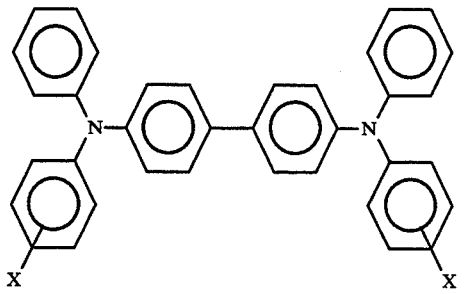

wherein X is selected from the group consisting of an alkyl group, having from 1 to about 4 carbon atoms, and chlorine, the photoconductive layer exhibiting the capability of photogeneration of holes and injection of the holes. The hole transport layer is substantially non-absorbing in the spectral region at which the photoconductive layer generates and injects photogenerated holes, but is capable of supporting the injection of photogenerated holes from the photoconductive layer and transporting the holes through the hole transport layer.

Any conductive layer of an electrophotographic device may comprise the material of the invention, including, for example, the ground plane layer and the ground strip 9.

The invention will be further illustrated in the following, non-limitative examples, it being understood that these examples are intended to be illustrative only. The invention is not intended to be limited to the materials, conditions, process parameters and the like recited herein.

Example 1

In a 125 milliliter Erlenmeyer flask blanketed with an inert atmosphere is added 100 milligrams of $TCNQ_2$/quinoline synthesized according to the procedure of Melby et al, supra. Approximately 30 mls of distilled cylcopentanone is added and the mixture is heated to 70° C. About 15 mls of the resulting green solution is sprayed at room temperature by a SPRAYON JET PAK unit No. 62 onto a Mylar substrate sheet measuring 16 inches by 36 inches, and forms a yellowish film. The yellowish film gradually darkens to form conductive fibrils after about two minutes. The remaining solution is applied over the dry film. No disruption of the film occurs. Up to 6 passes are sprayed, allowing the solution to air dry between each pass.

Example 2

One gm of Lexan 145 (a polycarbonate from General Electric Company is placed in 10 mls of distilled cyclopentanone. To the polymer solution, $TCNQ_2$/isoquinoline is added to make 2%, 4% and 6% solutions (0.02 g, 0.04 g, 0.06 g). The mixture is warmed to effect a solution. The solution is coated on Mylar sheets using a 0.5 mil drawbar. The 2% solution film has no conductivity. The 4% solution film is highly conductive with fan-like dendritic structures. The 6% solution film has fibril structures which are highly conductive.

Example 3

The procedure of Example 2 is repeated, using 4,4'-cyclohexylidene diphenyl polycarbonate as the polymer and distilled cyclohexanone as the solvent in 2.5% and 1% solutions. Highly conductive and uniform dendritic structures are formed from coating 2.5% solutions. By slowing the evaporation rate by covering the film with a watch glass, the 1% solutions are also found to form conductive films.

Example 4

The procedure of Example 2 is repeated with different polymers substituted for Lexan 145. Ten percent solutions of $TCNQ_2$/isoquinoline are used. The following Table 2 summarizes the polymers and the resulting type of crystal structure and conductivity. The results of Table 2 show that faster solvent losses provide greater conductivities. Therefore, faster drying times are desirable for polymer/charge transport complex mixtures only.

TABLE 2

| | Crystal Structure | Resistivity (ohms/sq) |
|---|---|---|
| du Pont 49K (Polyester) | dendritic | >2000 |
| Pliolite | dendritic | <2000 |
| PE-200 (polyester) | dendritic | <2000 |
| Polystyrene | dendritic | <2000 |
| Hydroxypropyl cellulose | dendritic | <2000 |
| Polyacrylic acid | dendritic | <2000 |
| Gantrez 169 (GAF) | sphericulites | <2000 |
| Polyvinyl acetate | sphericulites | >2000 |

Example 5

Drawbar coatings using solvent mixtures are carried out using various amounts of alcohols with cyclopentanone as solvent. Five grams of polyacrylic acid per 100 mls of solvent as the polymer and 5% $TCNQ_2$/isoquinoline (0.05 g/1 g polymer) are used. The most conductive films are obtained from high methanol solutions (70/30 methanol/cyclopentanone). Films having a thickness greater than about 1.5 mil are less conductive.

Example 6

The procedure of Example 5 is repeated substituting cyclohexanone (with a slower evaporation rate) for the cyclopentanone of Example 5. The result is films which are less conductive

Example 7

PE-200 solutions of $TCNQ_2$/isoquinoline are sprayed using distilled cyclopentanone as the solvent. Very useful, highly conductive films are obtained.

Example 8

The results in Table 3 show sheet resistivity and conductivity of various samples of the present invention. $TCNQ_2$/quinoline solution of Example 1 is sprayed in various concentrations, forming uncoated fibrils.

TABLE 3

| $TCNQ_2$/quinoline Solvent Loading | |
|---|---|
| Sample Coverage (mq/sq. ft) | Sheet Resistivity (ohms/sq) |
| 125 | $2.7 \times 10^3$ |
| 100 | $2.3 \times 10^3$ |
| 50 | $7.9 \times 10^3$ |
| 25 | $1.6 \times 10^4$ |
| 10 | $5.8 \times 10^4$ |

Thus, the resistivity increases as the loading of the spraying solution is decreased. This is due to the fact that thickness of the films is decreased if the solution is diluted. The resistivity of the samples does not change with the temperature varying from 30° C. to 140° C. The samples chemically decompose if exposed to air at temperatures above 140° C.

Example 9

Conductivity measurements are performed with a polymer matrix of 100 mg polymer/10 mg of $TCNQ_2$/quinoline charge transfer complex. The coatings are cast, using 100 mls (95 gms) cyclopentanone as the solvent for 5 gms polymer and 0.5 gm $TCNQ_2$/quinoline, in a thickness of about 1–2 microns by drawbar coating. The resistivity results using various polymers are shown in Table 4.

TABLE 4

| 100 mg Polymer/10 mg $TCNQ_2$/quinoline | Sheet Resistivity (ohms/sq) |
|---|---|
| Polysulfone | 300 |
| Polystyrene | 400 |
| Polyvinylacetate | 400 |
| Phenoxy | 500 |
| du Pont 49,000 | 600 |
| Polymethylmethacrylate | 700 |
| Polycarbonate (2) | 800 |
| Hydroxypropyl Cellulose | 800 |
| PE-200 | 900 |
| Gantrez-169 | 2000 |
| Polyvinyl Carbazole | 7000 |
| Polyvinyl Chloride | non-conductive (N.C.) |
| Polyvinyl Pyridine | N.C. |
| Polyvinyl Pyrrolidone | N.C. |

Example 10

The charge transfer complex compositions of the present invention are fabricated in an electrophotographic imaging member as a ground plane layer. The compositions are coated having a thickness of 1 to 2 microns onto a substrate of Mylar, from E. I. du Pont de Nemours & Co., having a thickness of about 125 microns. A blocking layer is coated onto the ground plane layer. The blocking layer solution must penetrate and coat the fibrils in the ground plane layer without interacting therewith.

The optimum blocking layer comprises a dual blocking layer. Blocking layer No. 1 is coated directly on the ground plane layer and has a thickness of about 1 micron to about 2 microns. A typical formulation is a 3% (wt/vol) polyacrylic acid/methanol solution using a 1 mil drawbar. Blocking layer No. 2 may contain hydrolyzed Gantrez-169 containing quinoline to complex with stray TCNQ. Blocking layer No. 2 is coated directly on blocking layer No. 1. A typical formulation for blocking layer No. 2 is 3% quinoline (wt/vol) and Gantrez-169 in methanol coated with a 0.5 mil drawbar. The thickness of the second blocking layer may be from about 0.3 micron to about 2.0 microns.

Table 5 shows various polymers used in the second blocking layer, along with their electrical properties.

TABLE 5

| Electrical Properties of Blocking Layer No. 2 | | |
|---|---|---|
| Polymer | $V_o$ | $V_r$ |
| Polyacrylic Acid (PAA) | 600 | 0 |
| PAA + Quinoline (Q) | 800 | 0 |
| Gantrez (G-169) | 580 | 20 |

TABLE 5-continued

| Electrical Properties of Blocking Layer No. 2 | | |
|---|---|---|
| Polymer | $V_o$ | $V_r$ |
| G-169 + Q | 760 | 10 |
| Polyvinyl pyridine (PVP) | 700 | 30 |
| PVP + Q | 800 | <10 |

The cyclic data indicate that the compositions are humidity insensitive.

A dispersion is prepared by charging into a 4 ounce glass bottle 14 milliliters of toluene, 14 milliliters of tetrahydrofuran, 1.6 grams of a polyvinylcarbazole, 1.6 grams of sodium doped (100 ppm) trigonal selenium powder, and 200 grams of stainless steel shot. The mixture is then roll milled for 5 days resulting in a dispersion, 20 percent by volume, of sodium doped trigonal selenium particles, 0.1 micron in diameter in polyvinyl carbazole polymer solution, 80 percent by volume. The mixture is used to prepare a photogenerating layer.

The photogenerating layer is coated on the blocking layer, using a 0.005 inch Bird applicator, followed by drying at 130° C. for 5 minutes. The photogenerating layer has a thickness of 0.5 microns. Subsequently, a transport layer solution containing 7.35 grams, 50 percent by weight, of the polycarbonate material commercially available as Makrolon, and 7.35 grams, 50 percent by weight, of N,N'diphenyl-N,N'-bis(3-methyl)1,1'-biphenyl-4,4'-diamine, dissolved in 85.3 grams of methylene chloride, is coated on the photogenerating layer with a 0.005 inch Bird applicator. The resulting layer is then dried at 100° C. for 5 minutes, and then dried at 135° C. for 5 minutes. The resulting charge transport layer has a thickness of 25 microns.

While the invention has been described with reference to particular preferred embodiments, the invention is not limited to the specific examples, and other embodiments and modifications can be made by those skilled in the art without departing from the spirit and scope of the invention.

What is claimed is:

1. An electrically conductive composition comprising about 1 to about 40 weight percent of a charge transfer complex of a TCNQ salt and a donor molecule, wherein said charge transfer complex is in the form of at least one member selected from the group consisting of fibrils and sphericulites, said composition having been obtained by evaporating a solvent containing said TCNQ salt and donor molecule, said solvent having a relative evaporation rate less than about 30.

2. The composition of claim 1, wherein said donor molecule contains a 6-membered aromatic heterocycle containing nitrogen.

3. The composition of claim 1, wherein said donor molecule is a pyridine molecule or derivative thereof.

4. The composition of claim 1, wherein said donor molecule is selected from the group consisting of pyridine, 3-picoline, 4-picoline, quinoline, quinaldine, lepidine, L-methylquinoline, isoquinoline, acridine, phenanthridine, 7,8-benzoquinoline, methyl pyrazinium, methyl quinoxalinium, methyl acridinium, 2,2-bipyridine, 4,4-bipyridine, 1,10-phenanthroline and methyl-1,10-phenanthrolinium.

5. The composition of claim 1, wherein said charge transfer complex following evaporation is in the form of fibrils.

6. The composition of claim 5, wherein said fibrils have a diameter of about 0.25 micron to about 2.0 microns, and a length of about 50 microns to about 500 microns.

7. The composition of claim 1, wherein said solvent is selected from the group consisting of cyclohexanone, cyclopentanone, propyleneglycolmonomethylether acetate, and mixtures thereof.

8. The composition of claim 1, having a resistivity less than about 100,000 ohms/sq.

9. An electrophotographic imaging member comprising a ground plane layer containing the composition of claim 1.

10. The member of claim 9, wherein said ground plane layer has a thickness of about 0.5 micron to about 5.0 microns.

11. The member of claim 9, wherein said ground plane layer has a resistivity less than about 100,000 ohms/sq.

12. The member of claim 9, further comprising first and second blocking layers.

13. The member of claim 12, wherein said first blocking layer comprises an acidic or neutral polymer unreactive with said composition, and said second blocking layer comprises a basic polymer which prevents charge transfer complex migration.

14. The member of claim 9, further comprising a substrate, at least one blocking layer, a charge generating layer and a charge transport layer, wherein said conductive layer is located between said substrate and said blocking layer.

15. The composition of claim 1, further comprising a polymer.

16. The composition of claim 15, wherein said polisher is selected from the group consisting of polycarbonates, polyesters, polyacrylates, polyvinylacetates, phenoxy resins, hydroxy alkyl celluloses, polysulfones, and polystyrene.

17. The composition of claim 15, comprising about 2 to about 20 weight percent of said charge transfer complex based on weight of said polymer.

18. A method of forming an electrically conductive composition, comprising preparing a liquid preparation of components of said conductive composition in a solvent having a relative evaporation rate of less than about 30, and evaporating said solvent to form said composition, wherein said composition comprises a charge transfer complex of a TCNQ salt and a donor molecule, and said charge transfer complex is in the form of at least one member selected from the group consisting of fibrils and sphericulites.

19. The method of claim 18, wherein said donor molecule contains a 6-membered aromatic heterocycle containing nitrogen.

20. The method of claim 18, wherein said donor molecule is a pyridine molecule or derivative thereof.

21. The method of claim 18, wherein polisher is mixed with said solvent.

22. The method of claim 21, wherein said polymer is selected from the group consisting of polycarbonates, polyesters, polyacrylates, polyvinylacetates, phenoxy resins, hydroxy alkyl celluloses, polysulfones, and polystyrene.

23. The method of claim 22, wherein about 1 to 40 weight percent of said charge transfer complex based on weight of said polymer is contained in said composition.

24. The method of claim 22, wherein said solution is sprayed to form a film of said composition.

25. The method of claim 22, wherein said solution is drawbar coated to forth a film of said composition.

26. The method of claim 18, wherein said solvent is selected from the group consisting of cylcohexanone, cyclopentanone, propyleneglycolmonomethylether acetate, and mixtures thereof.

27. The method of claim 18, wherein said charge transfer complex forms fibrils upon evaporation of said solvent.

28. The method of claim 27, wherein said fibrils have a diameter of about 0.25 micron to about 2.0 microns, and a length of about 50 microns to about 500 microns.

29. A method of making a conductive layer on an electrophotographic imaging member, comprising the steps of:

preparing a liquid preparation of components of said conductive layer in a solvent having a relative evaporation rate of less than about 30;

coating said liquid preparation on a substrate; and evaporating said solvent to form a conductive layer, wherein said conductive layer comprises a charge transfer complex of TCNQ salt and a donor molecule, said charge transfer complex being in the form of at least one member selected from the group consisting of fibrils and sphericulites.

30. The method of claim 29, wherein said conductive layer has a thickness of about 0.5 micron to about 5 microns.

31. The method of claim 29, wherein said conductive layer has a resistivity less than 100,000 ohms/sq.

32. The method of claim 29, wherein said conductive layer further comprises a polymer.

33. The method of claim 32, wherein said polymer is selected from the group consisting of polycarbonates, polyesters, polyacrylates, polyvinylacetates, phenoxy resins, hydroxy alkyl celluloses, polysulfones and polystyrene.

* * * * *